US008467896B2

(12) United States Patent
Qian et al.

(10) Patent No.: US 8,467,896 B2
(45) **Date of Patent: *Jun. 18, 2013**

(54) FEEDBACK FOR POLISHING RATE CORRECTION IN CHEMICAL MECHANICAL POLISHING

(75) Inventors: Jun Qian, Sunnyvale, CA (US); Charles C. Garretson, Sunnyvale, CA (US); Sivakumar Dhandapani, San Jose, CA (US); Jeffrey Drue David, San Jose, CA (US); Harry Q. Lee, Los Altos, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/480,434

(22) Filed: May 24, 2012

(65) Prior Publication Data

US 2012/0231701 A1 Sep. 13, 2012

Related U.S. Application Data

(63) Continuation of application No. 12/781,644, filed on May 17, 2010, now Pat. No. 8,190,285.

(51) Int. Cl.

| | |
|---|---|
| ***G06F 19/00*** | (2006.01) |
| ***B24B 49/04*** | (2006.01) |
| ***B24B 49/12*** | (2006.01) |

(52) U.S. Cl.

USPC ..... 700/160; 700/173; 700/175; 451/5

(58) Field of Classification Search

USPC ..... 700/105, 121, 159, 160, 164, 172, 700/173, 174; 451/5, 6, 66; 438/5, 14, 692

See application file for complete search history.

(56) References Cited

U.S. PATENT DOCUMENTS

| | | | | |
|---|---|---|---|---|
| 7,409,260 | B2 | 8/2008 | David et al. | |
| 7,774,086 | B2 | 8/2010 | David et al. | |
| 8,039,397 | B2 | 10/2011 | David et al. | |
| 8,190,285 | B2 * | 5/2012 | Qian et al. | 700/160 |
| 2003/0022400 | A1 | 1/2003 | Nomoto et al. | |
| 2007/0224915 | A1 | 9/2007 | David et al. | |
| 2009/0036026 | A1 | 2/2009 | David et al. | |
| 2010/0056023 | A1 | 3/2010 | David et al. | |
| 2010/0103422 | A1 | 4/2010 | David et al. | |

(Continued)

OTHER PUBLICATIONS

International Search Report for PCT/US2011/033998, mailed Jan. 4, 2012, 11 pages.

*Primary Examiner* — Charles Kasenge
(74) *Attorney, Agent, or Firm* — Fish & Richardson P.C.

(57) ABSTRACT

A substrate having a plurality of zones is polished and spectra are measured. For each zone, a first linear function fits a sequence of index values associated with reference spectra that best match the measured spectra. A projected time at which a reference zone will reach the target index value is determined based on the first linear function, and for at least one adjustable zone, a polishing parameter adjustment is calculated such that the adjustable zone has closer to the target index at the projected time than without such adjustment. The adjustment is calculated based on a feedback error calculated for a previous substrate. The feedback error for a subsequent substrate is calculated based on a second linear function that fits a sequence of index values associated with reference spectra that best match spectra measured after the polishing parameter is adjusted.

21 Claims, 12 Drawing Sheets

U.S. PATENT DOCUMENTS

2010/0105288 A1 4/2010 David et al.
2010/0114532 A1 5/2010 David et al.
2010/0120330 A1 5/2010 Zhang et al.
2010/0217430 A1 8/2010 David et al.

* cited by examiner

FEEDBACK FOR POLISHING RATE CORRECTION IN CHEMICAL MECHANICAL POLISHING

CROSS-REFERENCE TO RELATED APPLICATIONS

This application is a continuation of U.S. patent application Ser. No. 12/781,644, filed May 17, 2010, the entire disclosure of which is incorporated herein by reference.

TECHNICAL FIELD

The present disclosure relates generally to feedback to affect polishing rate corrections during chemical mechanical polishing.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier head. The exposed surface of the substrate is typically placed against a rotating polishing pad with a durable roughened surface. The carrier head provides a controllable load on the substrate to push it against the polishing pad. A polishing liquid, such as a slurry with abrasive particles, is typically supplied to the surface of the polishing pad.

One problem in CMP is using an appropriate polishing rate to achieve a desirable profile, e.g., a substrate layer that has been planarized to a desired flatness or thickness, or a desired amount of material has been removed. Variations in the initial thickness of a substrate layer, the slurry composition, the polishing pad condition, the relative speed between the polishing pad and a substrate, and the load on a substrate can cause variations in the material removal rate across a substrate, and from substrate to substrate. These variations cause variations in the time needed to reach the polishing endpoint and the amount removed. Therefore, it may not be possible to determine the polishing endpoint merely as a function of the polishing time, or to achieve a desired profile merely by applying a constant pressure.

In some systems, a substrate is optically monitored in-situ during polishing, e.g., through a window in the polishing pad. However, existing optical monitoring techniques may not satisfy increasing demands of semiconductor device manufacturers.

SUMMARY

In one aspect, a computer-implemented method includes polishing a substrate having a plurality of zones, a polishing rate of each zone is independently controllable by an independently variable polishing parameter, storing a target index value, measuring a sequence of spectra from each zone during polishing with an in-situ monitoring system, for each measured spectrum in the sequence of spectra for each zone, determining a best matching reference spectrum from a library of reference spectra, for each best matching reference spectrum for each zone, determining an index value to generate a sequence of index values, for each zone, fitting a first linear function to the sequence of index values, for a reference zone from the plurality of zones, determining a projected time at which the reference zone will reach the target index value based on the first linear function of the reference zone, and for at least one adjustable zone, calculating an adjustment for the polishing parameter for the adjustable zone to adjust the polishing rate of the adjustable zone such that the adjustable zone has closer to the target index at the projected time than without such adjustment, the calculation including calculating the adjustment based on a feedback error calculated for a previous substrate, after adjustment of the polishing parameter, for each zone, continuing to measure the sequence of spectra, determine a best matching reference spectrum from a library of reference spectra, and determine an index value to generate a second sequence of index values obtained after the adjustment of the polishing parameter, for the at least one adjustable zone of each substrate, fitting a second linear function to the second sequence of index values, and calculating the feedback error for a subsequent substrate for the at least one adjustable zone based on the second linear function and the desired slope.

Implementations can include one or more of the following features. The polishing parameter may be a pressure in a carrier head of the polishing apparatus. For each adjustable zone, a time at which the adjustable zone will reach the target index may be determined. The polishing parameter may be adjusted for the at least one adjustable zone such that the least one adjustable zone has closer to the target index at the projected time than without such adjustment. Adjusting the polishing parameter may include calculating a desired slope for the adjustable zone. A projected index may be calculated for the adjustable zone at which the linear function for the adjustable zone reaches the projected time. Calculating the desired slope SD for a zone may include calculating SD=(IT−I)/(TE−T0), wherein T0 is the time at which the polishing parameter is to be changed, TE is the projected endpoint time, IT is the target index, and I is the index value of the zone at time T0. Determining the first linear function may include determining a slope S for the first linear function for a time before time T0. Adjusting the polishing parameter may include calculating an adjusted pressure Padj=(Pnew−Pold)*err+Pnew, where err is the feedback error, where Pnew=Pold*SD/S, and where Pold is the pressure applied to the zone before time T0. An actual slope S' may be determined from the second linear function. The feedback error err is calculated as err=[(SD−S')/SD]. Whether the desired slope SD of the adjustable zone is greater than the slope S of the adjustable zone may be determined before the adjustment to the polishing parameter. The feedback error err is may be calculated as err=[(SD−S')/SD] if SD>S and the feedback error err is calculated as err=[(S'−SD)/SD] if SD<S. The feedback error err may be calculated from an accumulation of feedback errors of the adjustable zone from a plurality of prior substrates. Calculating the desired slope SD for a zone may include calculating SD=(ITadj−I)/(TE−T0), where T0 is the time at which the polishing parameter is to be changed, TE is the projected endpoint time, ITadj is an adjusted target index, and I is the index value of the adjustable zone at time T0.

Adjusting the polishing parameter may includes calculating the new pressure Pnew=Pold*SD/S, where Pold is the pressure applied to the zone before time T0, and slope S is the first linear function for a time before time T0. A starting index SI at the time T0 when the polishing parameter is changed may be calculated. The adjusted target index ITadj may be calculated as ITadj=SI+(IT−SI)*(1+err), IT is the target index, and SI is the starting index. An actual index AI reached by the adjustable zone at an endpoint time TE' may be determined. Determining the actual index AI may includes calculating a value of the second function at the endpoint time TE'. The error err may be calculated as err=[(IT−AI)/(IT−SI)], where AI is the actual index, SI is the starting index and IT is the target index.

In other aspects, polishing systems and computer-program products tangibly embodied on a computer readable medium are provided to carry out these methods.

Certain implementations may have one or more of the following advantages. If all of the substrates on the same platen endpoint at approximately the same time, defects can be avoided, such as scratches caused by rinsing a substrate with water too early or corrosion caused by failing to rinse a substrate in a timely manner. Equalizing polishing times across multiple substrates can also improve throughput. Equalizing polishing times for different zones within a substrate can also decrease within-wafer non-uniformity (WIWNU), i.e., improve substrate layer uniformity. Feedback can decrease wafer-to-wafer non-uniformity (WTWNU), e.g., by compensating for process drift, e.g., wear of the polishing pad or changes in polishing temperature.

The details of one or more embodiments are set forth in the accompanying drawings and the description below. Other features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

Where multiple substrates are being polished simultaneously, e.g., on the same polishing pad, polishing rate variations between the substrates can lead to the substrates reaching their target thickness at different times. On the one hand, if polishing is halted simultaneously for the substrates, then some will not be at the desired thickness. On the other hand, if polishing for the substrates is stopped at different times, then some substrates may have defects and the polishing apparatus is operating at lower throughput.

By determining a polishing rate for each zone for each substrate from in-situ measurements, a projected endpoint time for a target thickness or a projected thickness for target endpoint time can be determined for each zone for each substrate, and the polishing rate for at least one zone of at least one substrate can be adjusted so that the substrates achieve closer endpoint conditions. By "closer endpoint conditions," it is meant that the zones of the substrates would reach their target thickness closer to the same time than without such adjustment, or if the substrates halt polishing at the same time, that the zones of the substrates would have closer to the same thickness than without such adjustment.

Figure 1:
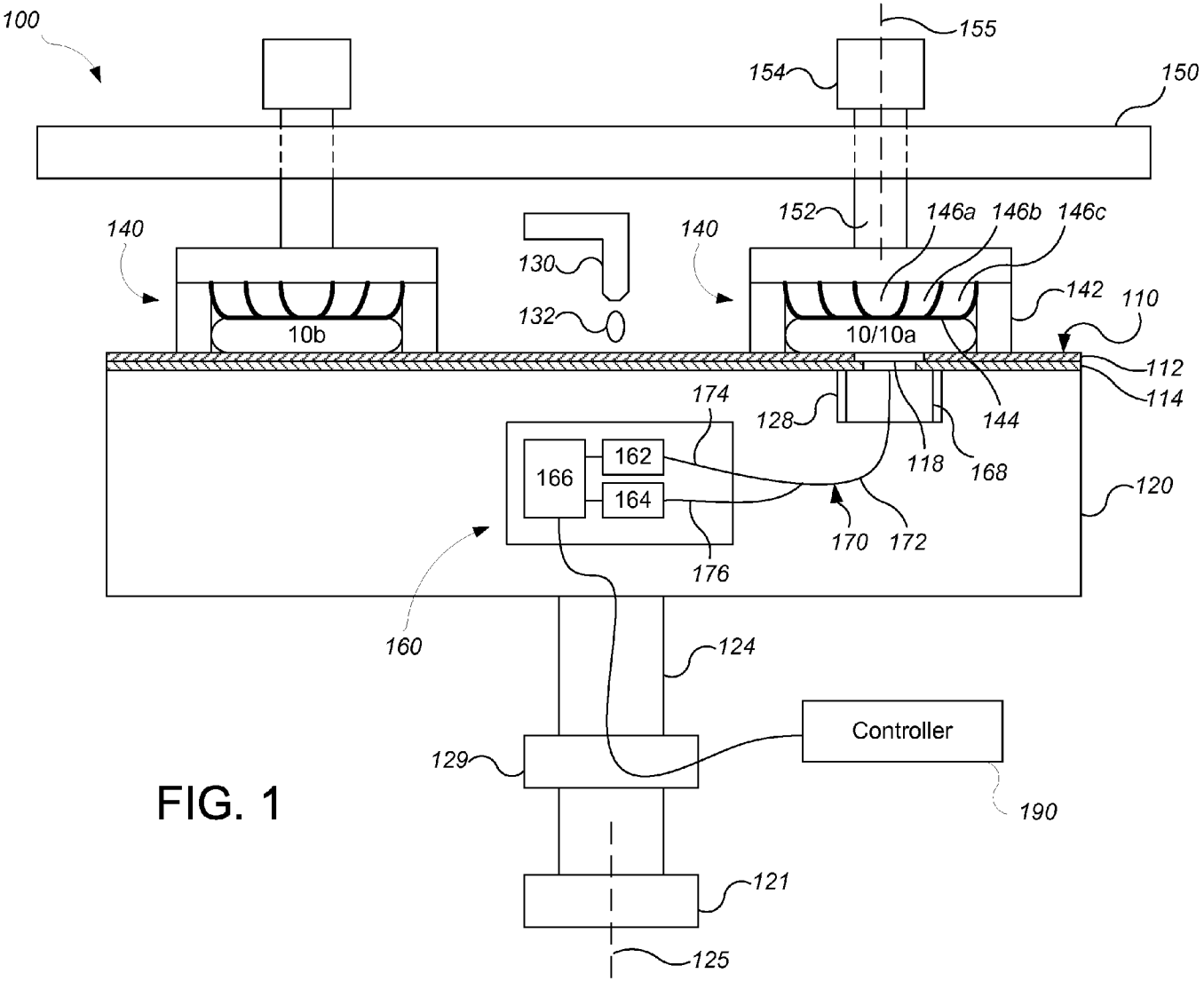
FIG. 1 illustrates a schematic cross-sectional view of an example of a polishing apparatus having two polishing heads.

FIG. 1 illustrates an example of a polishing apparatus 100. The polishing apparatus 100 includes a rotatable disk-shaped platen 120 on which a polishing pad 110 is situated. The platen is operable to rotate about an axis 125. For example, a motor 121 can turn a drive shaft 124 to rotate the platen 120. The polishing pad 110 can be detachably secured to the platen 120, for example, by a layer of adhesive. The polishing pad 110 can be a two-layer polishing pad with an outer polishing layer 112 and a softer backing layer 114.

The polishing apparatus 100 can include a combined slurry/rinse arm 130. During polishing, the arm 130 is operable to dispense a polishing liquid 132, such as a slurry, onto the polishing pad 110. While only one slurry/rinse arm 130 is shown, additional nozzles, such as one or more dedicated slurry arms per carrier head, can be used. The polishing apparatus can also include a polishing pad conditioner to abrade the polishing pad 110 to maintain the polishing pad 110 in a consistent abrasive state.

In this embodiment, the polishing apparatus 100 includes two (or two or more) carrier heads 140. Each carrier head 140 is operable to hold a substrate 10 (e.g., a first substrate 10*a* at one carrier head and a second substrate 10*b* at the other carrier head) against the polishing pad 110. Each carrier head 140 can have independent control of the polishing parameters, for example pressure, associated with each respective substrate.

Figure 2:
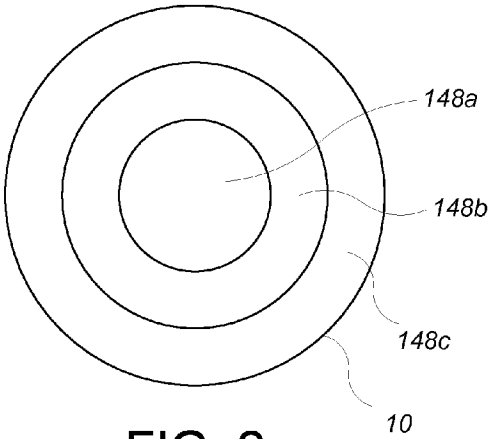
FIG. 2 illustrates a schematic top view of a substrate having multiple zones.

In particular, each carrier head 140 can include a retaining ring 142 to retain the substrate 10 below a flexible membrane 144. Each carrier head 140 also includes a plurality of independently controllable pressurizable chambers defined by the membrane, e.g., 3 chambers 146*a*-146*c*, which can apply independently controllable pressurizes to associated zones 148*a*-148*c* on the flexible membrane 144 and thus on the substrate 10 (see FIG. 2). Referring to FIG. 2, the center zone 148*a* can be substantially circular, and the remaining zones 148*b*-148*e* can be concentric annular zones around the center zone 148*a*. Although only three chambers are illustrated in FIGS. 1 and 2 for ease of illustration, there could be two chambers, or four or more chambers, e.g., five chambers.

Returning to FIG. 1, each carrier head 140 is suspended from a support structure 150, e.g., a carousel, and is connected by a drive shaft 152 to a carrier head rotation motor 154 so that the carrier head can rotate about an axis 155. Optionally each carrier head 140 can oscillate laterally, e.g., on sliders on the carousel 150; or by rotational oscillation of the carousel itself. In operation, the platen is rotated about its central axis 125, and each carrier head is rotated about its central axis 155 and translated laterally across the top surface of the polishing pad.

While only two carrier heads 140 are shown, more carrier heads can be provided to hold additional substrates so that the surface area of polishing pad 110 may be used efficiently. Thus, the number of carrier head assemblies adapted to hold substrates for a simultaneous polishing process can be based, at least in part, on the surface area of the polishing pad 110.

The polishing apparatus also includes an in-situ monitoring system 160, which can be used to determine whether to adjust a polishing rate or an adjustment for the polishing rate as discussed below. The in-situ monitoring system 160 can include an optical monitoring system, e.g., a spectrographic monitoring system, or an eddy current monitoring system.

In one embodiment, the monitoring system 160 is an optical monitoring system. An optical access through the polishing pad is provided by including an aperture (i.e., a hole that runs through the pad) or a solid window 118. The solid window 118 can be secured to the polishing pad 110, e.g., as a plug that fills an aperture in the polishing pad, e.g., is molded to or adhesively secured to the polishing pad, although in some implementations the solid window can be supported on the platen 120 and project into an aperture in the polishing pad.

The optical monitoring system 160 can include a light source 162, a light detector 164, and circuitry 166 for sending and receiving signals between a remote controller 190, e.g., a computer, and the light source 162 and light detector 164. One or more optical fibers can be used to transmit the light from the light source 162 to the optical access in the polishing pad, and to transmit light reflected from the substrate 10 to the detector 164. For example, a bifurcated optical fiber 170 can be used to transmit the light from the light source 162 to the substrate 10 and back to the detector 164. The bifurcated optical fiber an include a trunk 172 positioned in proximity to the optical access, and two branches 174 and 176 connected to the light source 162 and detector 164, respectively.

In some implementations, the top surface of the platen can include a recess 128 into which is fit an optical head 168 that holds one end of the trunk 172 of the bifurcated fiber. The optical head 168 can include a mechanism to adjust the vertical distance between the top of the trunk 172 and the solid window 118.

The output of the circuitry 166 can be a digital electronic signal that passes through a rotary coupler 129, e.g., a slip ring, in the drive shaft 124 to the controller 190 for the optical monitoring system. Similarly, the light source can be turned on or off in response to control commands in digital electronic signals that pass from the controller 190 through the rotary coupler 129 to the optical monitoring system 160. Alternatively, the circuitry 166 could communicate with the controller 190 by a wireless signal.

The light source 162 can be operable to emit white light. In one implementation, the white light emitted includes light having wavelengths of 200-800 nanometers. A suitable light source is a xenon lamp or a xenon mercury lamp.

The light detector 164 can be a spectrometer. A spectrometer is an optical instrument for measuring intensity of light over a portion of the electromagnetic spectrum. A suitable spectrometer is a grating spectrometer. Typical output for a spectrometer is the intensity of the light as a function of wavelength (or frequency).

As noted above, the light source 162 and light detector 164 can be connected to a computing device, e.g., the controller 190, operable to control their operation and receive their signals. The computing device can include a microprocessor situated near the polishing apparatus, e.g., a programmable computer. With respect to control, the computing device can, for example, synchronize activation of the light source with the rotation of the platen 120.

In some implementations, the light source 162 and detector 164 of the in-situ monitoring system 160 are installed in and rotate with the platen 120. In this case, the motion of the platen will cause the sensor to scan across each substrate. In particular, as the platen 120 rotates, the controller 190 can cause the light source 162 to emit a series of flashes starting just before and ending just after each substrate 10 passes over the optical access. Alternatively, the computing device can cause the light source 162 to emit light continuously starting just before and ending just after each substrate 10 passes over the optical access. In either case, the signal from the detector can be integrated over a sampling period to generate spectra measurements at a sampling frequency.

In operation, the controller 190 can receive, for example, a signal that carries information describing a spectrum of the light received by the light detector for a particular flash of the light source or time frame of the detector. Thus, this spectrum is a spectrum measured in-situ during polishing.

Figure 3A:
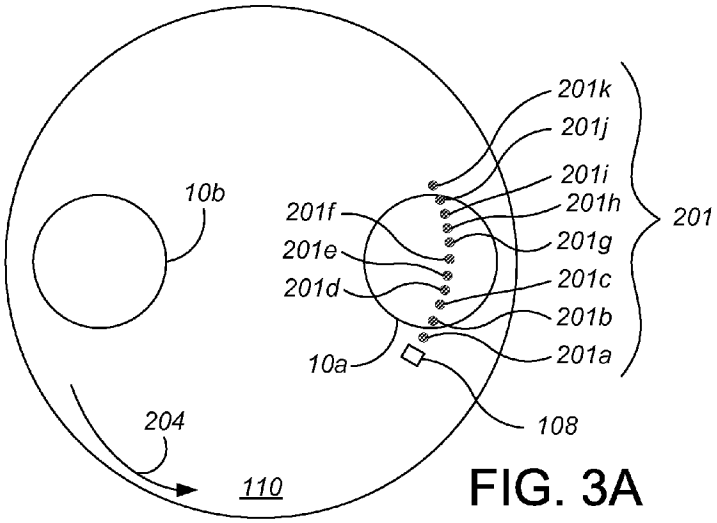
FIG. 3A illustrates a top view of a polishing pad and shows locations where in-situ measurements are taken on a first substrate.
Figure 3B:
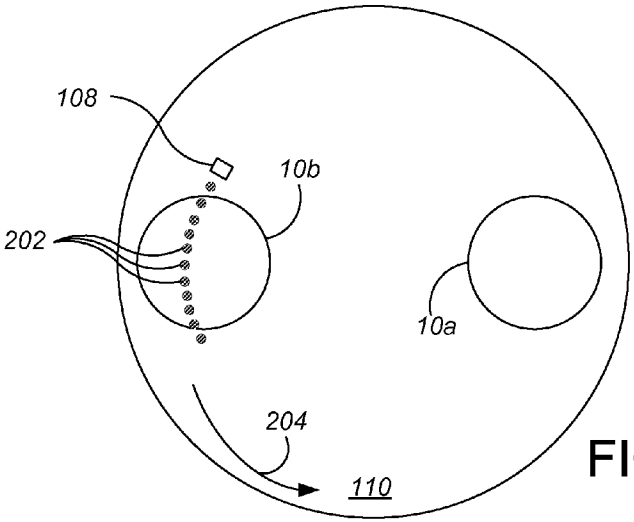
FIG. 3B illustrates a top view of a polishing pad and shows locations where in-situ measurements are taken on a second substrate.

As shown by in FIG. 3A, if the detector is installed in the platen, due to the rotation of the platen (shown by arrow 204), as the window 108 travels below one carrier head (e.g., the carrier head holding the first substrate 10*a*), the optical monitoring system making spectra measurements at a sampling frequency will cause the spectra measurements to be taken at locations 201 in an arc that traverses the first substrate 10*a*. For example, each of points 201*a*-201*k* represents a location of a spectrum measurement by the monitoring system of the first substrate 10*a* (the number of points is illustrative; more or fewer measurements can be taken than illustrated, depending on the sampling frequency). As shown, over one rotation of the platen, spectra are obtained from different radii on the substrate 10*a*. That is, some spectra are obtained from locations closer to the center of the substrate 10*a* and some are closer to the edge. Similarly, as shown by in FIG. 3B, due to the rotation of the platen, as the window travels below the other carrier head (e.g., the carrier head holding the second substrate 10*b*) the optical monitoring system making spectra measurements at the sampling frequency will cause the spectra measurements to be taken at locations 202 along an arc that traverses the second substrate 10*b*.

Thus, for any given rotation of the platen, based on timing and motor encoder information, the controller can determine which substrate, e.g., substrate 10*a* or 10*b*, is the source of the measured spectrum. In addition, for any given scan of the optical monitoring system across a substrate, e.g., substrate 10*a* or 10*b*, based on timing, motor encoder information, and optical detection of the edge of the substrate and/or retaining ring, the controller 190 can calculate the radial position (relative to the center of the particular substrate 10*a* or 10*b* being scanned) for each measured spectrum from the scan. The polishing system can also include a rotary position sensor, e.g., a flange attached to an edge of the platen that will pass through a stationary optical interrupter, to provide additional data for determination of which substrate and the position on the substrate of the measured spectrum. The controller can thus associate the various measured spectra with the controllable zones 148*b*-148*e* (see FIG. 2) on the substrates 10*a* and 10*b*. In some implementations, the time of measurement of the spectrum can be used as a substitute for the exact calculation of the radial position.

Over multiple rotations of the platen, for each zone of each substrate, a sequence of spectra can be obtained over time. Without being limited to any particular theory, the spectrum of light reflected from the substrate 10 evolves as polishing progresses (e.g., over multiple rotations of the platen, not during a single sweep across the substrate) due to changes in the thickness of the outermost layer, thus yielding a sequence of time-varying spectra. Moreover, particular spectra are exhibited by particular thicknesses of the layer stack.

In some implementations, the controller, e.g., the computing device, can be programmed to compare a measured spectrum to multiple reference spectra to and determine which reference spectrum provides the best match. In particular, the controller can be programmed to compare each spectrum from a sequence of measured spectra from each zone of each substrate to multiple reference spectra to generate a sequence of best matching reference spectra for each zone of each substrate.

As used herein, a reference spectrum is a predefined spectrum generated prior to polishing of the substrate. A reference spectrum can have a pre-defined association, i.e., defined prior to the polishing operation, with a value representing a time in the polishing process at which the spectrum is expected to appear, assuming that the actual polishing rate follows an expected polishing rate. Alternatively or in addition, the reference spectrum can have a pre-defined association with a value of a substrate property, such as a thickness of the outermost layer.

A reference spectrum can be generated empirically, e.g., by measuring the spectra from a test substrate, e.g., a test substrate having a known initial layer thicknesses. For example, to generate a plurality of reference spectra, a set-up substrate is polished using the same polishing parameters that would be used during polishing of device wafers while a sequence of spectra are collected. For each spectrum, a value is recorded representing the time in the polishing process at which the spectrum was collected. For example, the value can be an elapsed time, or a number of platen rotations. The substrate can be overpolished, i.e., polished past a desired thickness, so that the spectrum of the light that reflected from the substrate when the target thickness is achieved can be obtained.

In order to associate each spectrum with a value of a substrate property, e.g., a thickness of the outermost layer, the initial spectra and property of a "set-up" substrate with the same pattern as the product substrate can be measured pre-polish at a metrology station. The final spectrum and property can also be measured post-polish with the same metrology station or a different metrology station. The properties for spectra between the initial spectra and final spectra can be determined by interpolation, e.g., linear interpolation based on elapsed time at which the spectra of the test substrate was measured.

In addition to being determined empirically, some or all of the reference spectra can be calculated from theory, e.g., using an optical model of the substrate layers. For example, and optical model can be used to calculate a reference spectrum for a given outer layer thickness D. A value representing the time in the polishing process at which the reference spectrum would be collected can be calculated, e.g., by assuming that the outer layer is removed at a uniform polishing rate. For example, the time Ts for a particular reference spectrum can be calculated simply by assuming a starting thickness D0 and uniform polishing rate R (Ts=(D0−D)/R). As another example, linear interpolation between measurement times T1, T2 for the pre-polish and post-polish thicknesses D1, D2 (or other thicknesses measured at the metrology station) based on the thickness D used for the optical model can be performed (Ts=T2−T1*(D1−D)/(D1−D2)).

Figure 5:
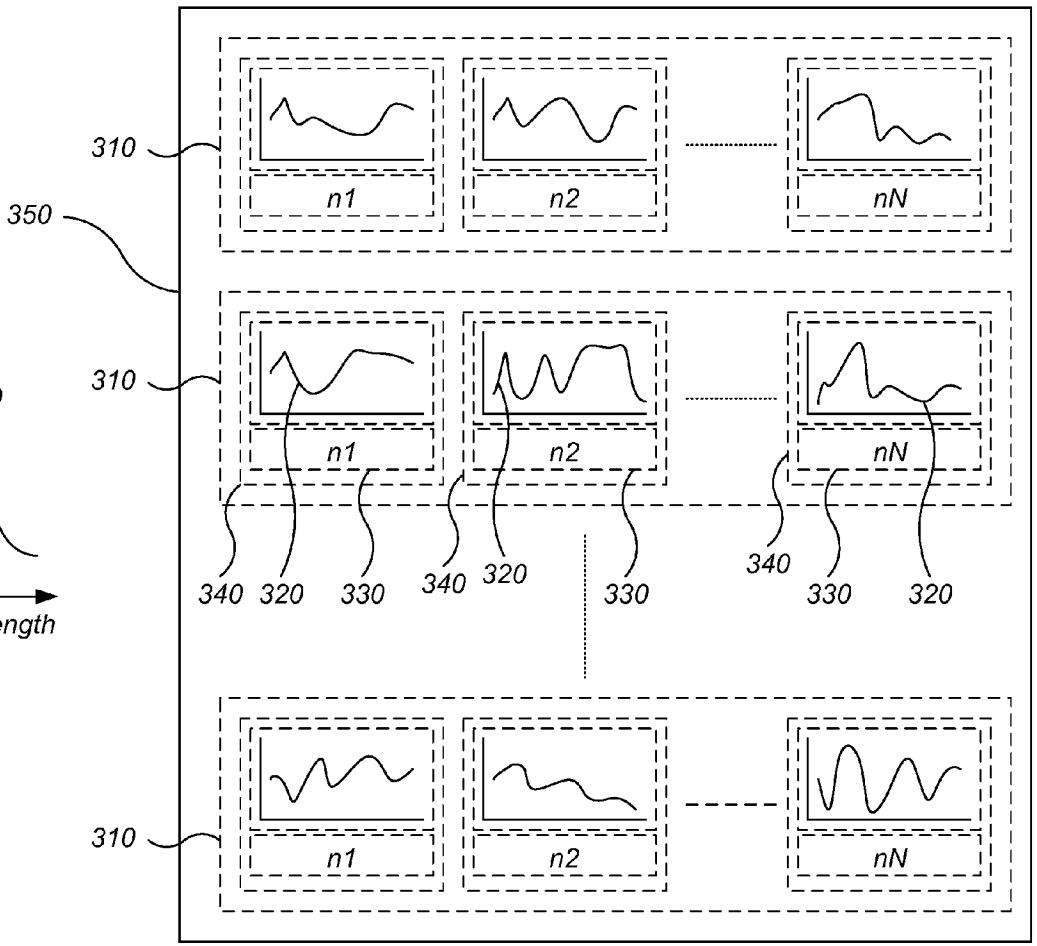
FIG. 5 illustrates a library of reference spectra.
Figure 4:
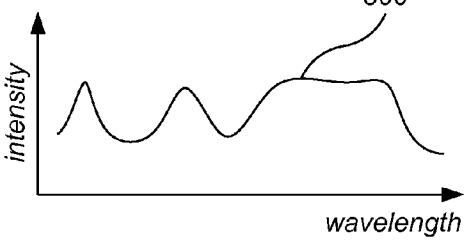
FIG. 4 illustrates a measured spectrum from the in-situ optical monitoring system.

Referring to FIGS. 4 and 5, a measured spectrum 300 (see FIG. 4) can be compared to reference spectra 320 from one or more libraries 310 (see FIG. 5). As used herein, a library of reference spectra is a collection of reference spectra which represent substrates that share a property in common. However, the property shared in common in a single library may vary across multiple libraries of reference spectra. For example, two different libraries can include reference spectra that represent substrates with two different underlying thicknesses. For a given library of reference spectra, variations in the upper layer thickness, rather than other factors (such as differences in wafer pattern, underlying layer thickness, or layer composition), can be primarily responsible for the differences in the spectral intensities.

Reference spectra 320 for different libraries 310 can be generated by polishing multiple "set-up" substrates with different substrate properties (e.g., underlying layer thicknesses, or layer composition) and collecting spectra as discussed above; the spectra from one set-up substrate can provide a first library and the spectra from another substrate with a different underlying layer thickness can provide a second library. Alternatively or in addition, reference spectra for different libraries can be calculated from theory, e.g., spectra for a first library can be calculated using the optical model with the underlying layer having a first thickness, and spectra for a second library can be calculated using the optical model with the underlying layer having a different one thickness.

In some implementations, each reference spectrum 320 is assigned an index value 330. In general, each library 310 can include many reference spectra 320, e.g., one or more, e.g., exactly one, reference spectra for each platen rotation over the expected polishing time of the substrate. This index 330 can be the value, e.g., a number, representing the time in the polishing process at which the reference spectrum 320 is expected to be observed. The spectra can be indexed so that each spectrum in a particular library has a unique index value. The indexing can be implemented so that the index values are sequenced in an order in which the spectra were measured. An index value can be selected to change monotonically, e.g., increase or decrease, as polishing progresses. In particular, the index values of the reference spectra can be selected so that they form a linear function of time or number of platen rotations (assuming that the polishing rate follows that of the model or test substrate used to generate the reference spectra in the library). For example, the index value can be proportional, e.g., equal, to a number of platen rotations at which the reference spectra was measured for the test substrate or would appear in the optical model. Thus, each index value can be a whole number. The index number can represent the expected platen rotation at which the associated spectrum would appear.

The reference spectra and their associated index values can be stored in a reference library. For example, each reference spectrum 320 and its associated index value 330 can be stored in a record 340 of database 350. The database 350 of reference libraries of reference spectra can be implemented in memory of the computing device of the polishing apparatus.

As noted above, for each zone of each substrate, based on the sequence of measured spectra or that zone and substrate, the controller 190 can be programmed to generate a sequence of best matching spectra. A best matching reference spectrum can be determined by comparing a measured spectrum to the reference spectra from a particular library.

In some implementations, the best matching reference spectrum can be determined by calculating, for each reference spectra, a sum of squared differences between the measured spectrum and the reference spectrum. The reference spectrum with the lowest sum of squared differences has the best fit. Other techniques for finding a best matching reference spectrum are possible.

A method that can be applied to decrease computer processing is to limit the portion of the library that is searched for matching spectra. The library typically includes a wider range of spectra than will be obtained while polishing a substrate. During substrate polishing, the library searching is limited to a predetermined range of library spectra. In some embodiments, the current rotational index N of a substrate being polished is determined. For example, in an initial platen rotation, N can be determined by searching all of the reference spectra of the library. For the spectra obtained during a subsequent rotation, the library is searched within a range of freedom of N. That is, if during one rotation the index number is found to be N, during a subsequent rotation which is X rotations later, where the freedom is Y, the range that will be searched from (N+X)−Y to (N+X)+Y.

Figure 6:
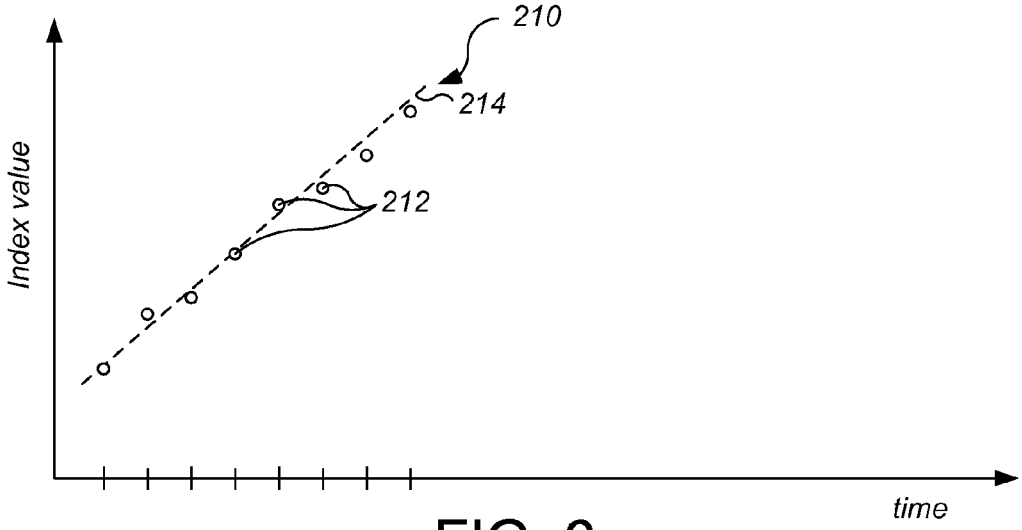
FIG. 6 illustrates an index trace.

Referring to FIG. 6, which illustrates the results for only a single zone of a single substrate, the index value of each of the best matching spectra in the sequence can be determined to generate a time-varying sequence of index values 212. This sequence of index values can be termed an index trace 210. In some implementations, an index trace is generated by comparing each measured spectrum to the reference spectra from exactly one library. In general, the index trace 210 can include one, e.g., exactly one, index value per sweep of the optical monitoring system below the substrate.

For a given index trace 210, where there are multiple spectra measured for a particular substrate and zone in a single sweep of the optical monitoring system (termed "current spectra"), a best match can be determined between each of the current spectra and the reference spectra of one or more, e.g., exactly one, library. In some implementations, each selected current spectra is compared against each reference spectra of the selected library or libraries. Given current spectra e, f, and g, and reference spectra E, F, and G, for example, a matching coefficient could be calculated for each of the following combinations of current and reference spectra: e and E, e and F, e and G, f and E, f and F, f and G, g and E, g and F, and g and G. Whichever matching coefficient indicates the best match, e.g., is the smallest, determines the best-matching reference spectrum, and thus the index value. Alternatively, in some implementations, the current spectra can be combined, e.g., averaged, and the resulting combined spectrum is compared against the reference spectra to determine the best match, and thus the index value.

In some implementations, for at least some zones of some substrates, a plurality of index traces can be generated. For a given zone of a given substrate, an index trace can be generated for each reference library of interest. That is, for each reference library of interest to the given zone of the given substrate, each measured spectrum in a sequence of measured spectra is compared to reference spectra from a given library, a sequence of the best matching reference spectra is determined, and the index values of the sequence of best matching reference spectra provide the index trace for the given library.

In summary, each index trace includes a sequence 210 of index values 212, with each particular index value 212 of the sequence being generated by selecting the index of the reference spectrum from a given library that is the closest fit to the measured spectrum. The time value for each index of the index trace 210 can be the same as the time at which the measured spectrum was measured.

Figure 7:
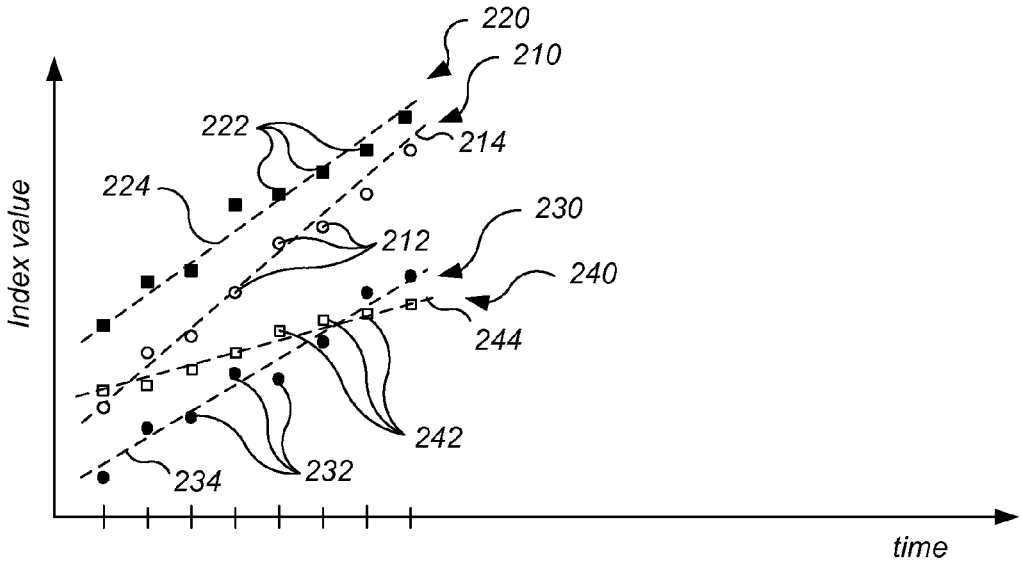
FIG. 7 illustrates a plurality of index traces for different zones of different substrates.

Referring to FIG. 7, a plurality of index traces is illustrated. As discussed above, an index trace can be generated for each zone of each substrate. For example, a first sequence 210 of index values 212 (shown by hollow circles) can be generated for a first zone of a first substrate, a second sequence 220 of index values 222 (shown by solid circles) can be generated for a second zone of the first substrate, a third sequence 230 of index values 232 (shown by hollow squares) can be generated for a first zone of a second substrate, and a fourth sequence 240 of index values 242 (shown by solid squares) can be generated for a second zone of the second substrate.

As shown in FIG. 7, for each substrate index trace, a polynomial function of known order, e.g., a first-order function (e.g., a line) is fit to the sequence of index values for the associated zone and wafer, e.g., using robust line fitting. For example, a first line 214 can be fit to index values 212 for the first zone of the first substrate, a second line 224 can be fit to the index values 222 of the second zone of the first substrate, a third line 234 can be fit to the index values 232 of the first zone of the second substrate, and a fourth line 244 can be fit to the index values 242 of the second zone of the second substrate. Fitting of a line to the index values can include calculation of the slope S of the line and an x-axis intersection time T at which the line crosses a starting index value, e.g., 0. The function can be expressed in the form $I(t)=S\cdot(t-T)$, where t is time. The x-axis intersection time T can have a negative value, indicating that the starting thickness of the substrate layer is less than expected. Thus, the first line 214 can have a first slope S1 and a first x-axis intersection time T1, the second line 224 can have a second slope S2 and a second x-axis intersection time T2, the third line 234 can have a third slope S3 and a third x-axis intersection time T3, and the fourth line 244 can have a fourth slope S4 and a fourth x-axis intersection time T4.

At some during the polishing process, e.g., at a time T0, a polishing parameter for at least one zone of at least one substrate, e.g., at least one zone of every substrate, is adjusted to adjust the polishing rate of the zone of the substrate such that at a polishing endpoint time, the plurality of zones of the plurality of substrates are closer to their target thickness than without such adjustment. In some embodiments, each zone of the plurality of substrates can have approximately the same thickness at the endpoint time.

Figure 8:
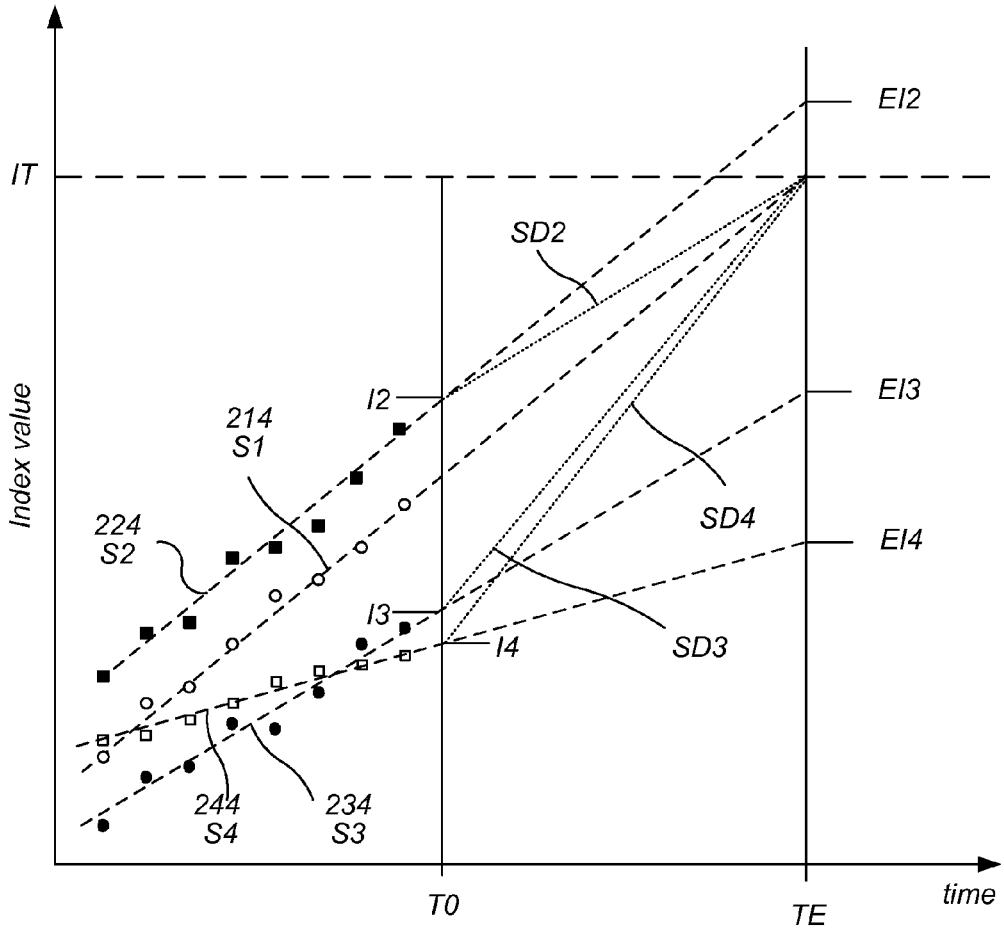
FIG. 8 illustrates a calculation of a plurality of desired slopes for a plurality of adjustable zones based on a time that an index trace of a reference zone reaches a target index.

Referring to FIG. 8, in some implementations, one zone of one substrate is selected as a reference zone, and a projected endpoint time TE at which the reference zone will reach a target index IT is determined. For example, as shown in FIG. 8, the first zone of the first substrate is selected as the reference zone, although a different zone and/or a different substrate could be selected. The target thickness IT is set by the user prior to the polishing operation and stored.

In order to determine the projected time at which the reference zone will reach the target index, the intersection of the line of the reference zone, e.g., line 214, with the target index, IT, can be calculated. Assuming that the polishing rate does not deviate from the expected polishing rate through the remainder polishing process, then the sequence of index values should retain a substantially linear progression. Thus, the expected endpoint time TE can be calculated as a simple linear interpolation of the line to the target index IT, e.g., IT=S·(TE−T). Thus, in the example of FIG. 8 in which the first zone of the second substrate is selected as the reference zone, with associated third line 234, IT=S1·(TE−T1), i.e., TE=IT/S1−T1.

One or more zones, e.g., all zones, other than the reference zone (including zones on other substrates) can be defined as adjustable zones. Where the lines for the adjustable zones meet the expected endpoint time TE define projected endpoint for the adjustable zones. The linear function of each adjustable zone, e.g., lines 224, 234 and 244 in FIG. 8, can thus be used to extrapolate the index, e.g., EI2, EI3 and EI4, that will be achieved at the expected endpoint time ET for the associated zone. For example, the second line 224 can be used to extrapolate the expected index, EI2, at the expected endpoint time ET for the second zone of the first substrate, the third line 234 can be used to extrapolate the expected index, EI3, at the expected endpoint time ET for the first zone of the second substrate, and the fourth line can be used to extrapolate the expected index, EI4, at the expected endpoint time ET for the second zone of the second substrate.

As shown in FIG. 8, if no adjustments are made to the polishing rate of any of the zones of any the substrates after time T0, then if endpoint is forced at the same time for all substrates, then each substrate can have a different thickness, or each substrate could have a different endpoint time (which is not desirable because it can lead to defects and loss of throughput). Here, for example, the second zone of the first substrate (shown by line 224) would endpoint at an expected index EI2 lower (and thus a thickness less) than the expected index of the first zone of the first substrate. Likewise, the first zone of the second substrate (shown by line 234) would endpoint at an expected index EI3 less (and thus a thickness less) than the first zone of the first substrate. The second zone of the second substrate (shown by line 244) would endpoint at an expected index EI4 greater (and thus a thickness greater) than the first zone of the first substrate.

If, as shown in FIG. 8, the target index will be reached at different times for different substrates (or equivalently, the adjustable zones will have different expected indexes at the projected endpoint time of reference zone), the polishing rate can be adjusted upwardly or downwardly, such that the substrates would reach the target index (and thus target thickness) closer to the same time than without such adjustment, e.g., at approximately the same time, or would have closer to the same index value (and thus same thickness), at the target time than without such adjustment, e.g., approximately the same index value (and thus approximately the same thickness).

Thus, in the example of FIG. 8, commencing at a time T0, at least one polishing parameter for the second zone of the first substrate is modified so that the polishing rate of the zone is decreased (and as a result the slope of the index trace 220 is decreased). Also, in this example, at least one polishing parameter for the second zone of the second substrate is modified so that the polishing rate of the zone is decreased (and as a result the slope of the index trace 240 is decreased). Similarly, in this example, at least one polishing parameter for the first zone of the second substrate is modified so that the polishing rate of the zone is increased (and as a result the slope of the index trace 240 is increased). As a result both zones of both substrates would reach the target index (and thus the target thickness) at approximately the same time (or if polishing of both substrates halts at the same time, both zones of both substrates will end with approximately the same thickness).

In some implementations, if the projected index at the expected endpoint time ET indicate that a zone of the substrate is within a predefined range of the target thickness, then no adjustment may be required for that zone. The range may be 2%, e.g., within 1%, of the target index.

The polishing rates for the adjustable zones can be adjusted so that all of the zones are closer to the target index at the expected endpoint time than without such adjustment. For example, a reference zone of the reference substrate might be chosen and the processing parameters for all of the other zone adjusted such that all of the zones will endpoint at approximately the projected time of the reference substrate. The reference zone can be, for example, a predetermined zone, e.g., the center zone 148*a* or the zone 148*b* immediately surrounding the center zone, the zone having the earliest or latest projected endpoint time of any of the zones of any of the substrates, or the zone of a substrate having the desired projected endpoint. The earliest time is equivalent to the thinnest substrate if polishing is halted at the same time. Likewise, the latest time is equivalent to the thickest substrate if polishing is halted at the same time. The reference substrate can be, for example, a predetermined substrate, a substrate having the zone with the earliest or latest projected endpoint time of the substrates. The earliest time is equivalent to the thinnest zone if polishing is halted at the same time. Likewise, the latest time is equivalent to the thickest zone if polishing is halted at the same time.

For each of the adjustable zones, a desired slope for the index trace can be calculated such that the adjustable zone reaches the target index at the same time as the reference zone. For example, the desired slope SD can be calculated from (IT−I)=SD*(TE−T0), where I is the index value (calculated from the linear function fit to the sequence of index values) at time T0 polishing parameter is to be changed, IT is the target index, and TE is the calculated expected endpoint time. In the example of FIG. 8, for the second zone of the first substrate, the desired slope SD2 can be calculated from (IT−I2)=SD2*(TE−T0), for the first zone of the second substrate, the desired slope SD3 can be calculated from (IT−I3)=SD3* (TE−T0), and for the second zone of the second substrate, the desired slope SD4 can be calculated from (IT−I4)=SD4* (TE−T0).

Figure 9:
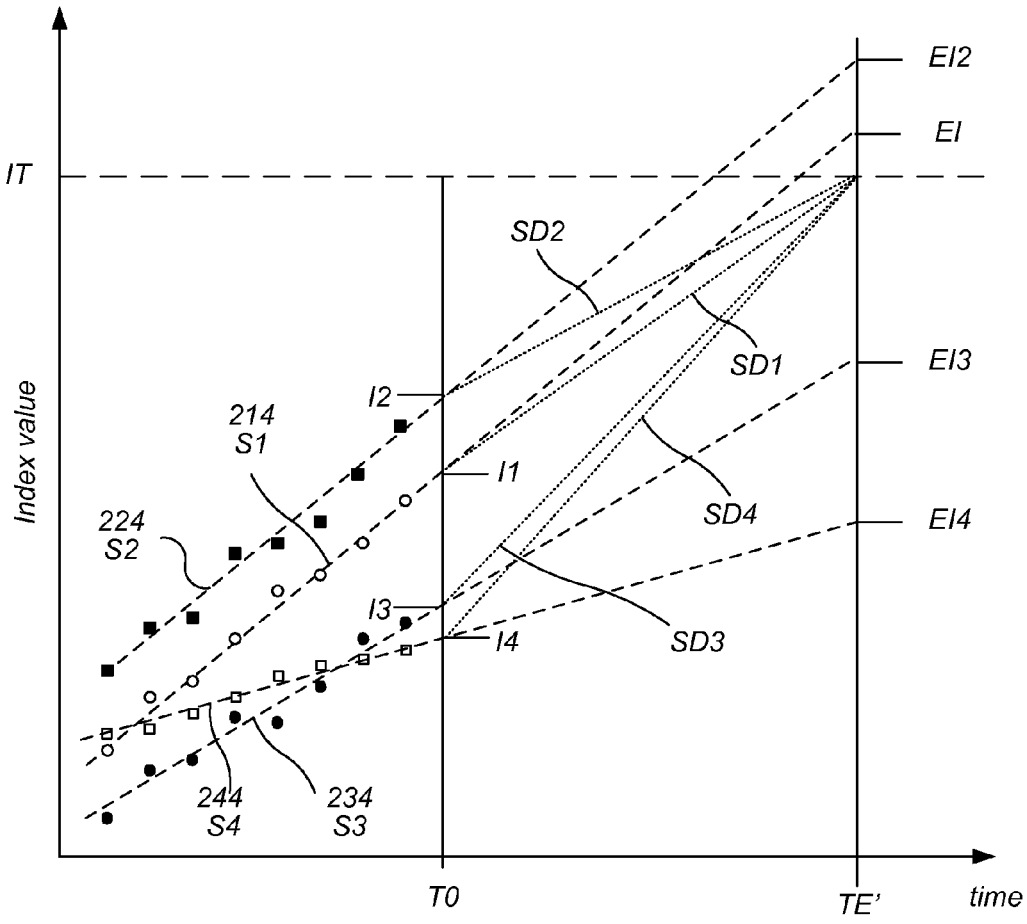
FIG. 9 illustrates a calculation of a plurality of desired slopes for a plurality of adjustable zones based on a time that an index trace of a reference zone reaches a target index.

Referring to FIG. 9, in some implementations, there is no reference zone. For example, the expected endpoint time TE' can be a predetermined time, e.g., set by the user prior to the polishing process, or can be calculated from an average or other combination of the expected endpoint times of two or more zones (as calculated by projecting the lines for various zones to the target index) from one or more substrates. In this implementation, the desired slopes are calculated substantially as discussed above (using the expected endpoint time TE' rather than TE), although the desired slope for the first zone of the first substrate must also be calculated, e.g., the desired slope SD1 can be calculated from (IT−I1)=SD1* (TE'−T0).

Figure 10:
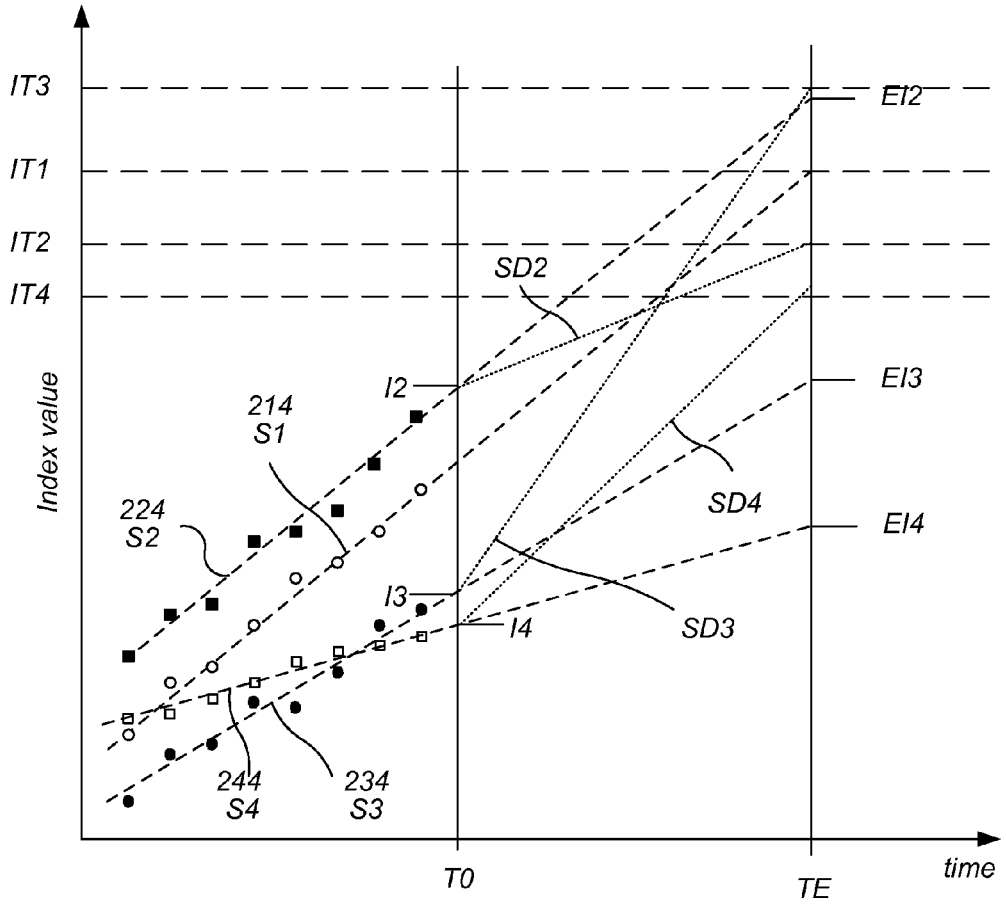
FIG. 10 illustrates a plurality of index traces for different zones of different substrates, with different zones having different target indexes.

Referring to FIG. 10, in some implementations, (which can also be combined with the implementation shown in FIG. 9), there are different target indexes for different zones. This permits the creation of a deliberate but controllable non-uniform thickness profile on the substrate. The target indexes can be entered by user, e.g., using an input device on the controller. For example, the first zone of the first substrate can have a first target indexes IT1, the second zone of the first substrate can have a second target indexes IT2, the first zone of the second substrate can have a third target indexes IT3, and the second zone of the second substrate can have a fourth target indexes IT4.

The desired slope SD for each adjustable zone can be calculated from (IT−I)=SD*(TE−T0), where I is the index value of the zone (calculated from the linear function fit to the sequence of index values for the zone) at time T0 at which the polishing parameter is to be changed, IT is the target index of the particular zone, and TE is the calculated expected endpoint time (either from a reference zone as discussed above in relation to FIG. 8, or from a preset endpoint time or from a combination of expected endpoint times as discussed above in relation to FIG. 9). In the example of FIG. 10, for the second zone of the first substrate, the desired slope SD2 can be calculated from (IT2−I2)=SD2*(TE−T0), for the first zone of the second substrate, the desired slope SD3 can be calculated from (IT3−I3)=SD3*(TE−T0), and for the second zone of the second substrate, the desired slope SD4 can be calculated from (IT4−I4)=SD4*(TE−T0).

For any of the above methods described above for FIGS. 8-10, the polishing rate is adjusted to bring the slope of index trace closer to the desired slope. The polishing rates can be adjusted by, for example, increasing or decreasing the pressure in a corresponding chamber of a carrier head. The change in polishing rate can be assumed to be directly proportional to the change in pressure, e.g., a simple Prestonian model. For example, for each zone of each substrate, where zone was polished with a pressure Pold prior to the time T0, a new pressure Pnew to apply after time T0 can be calculated as Pnew=Pold*(SD/S), where S is the slope of the line prior to time T0 and SD is the desired slope.

For example, assuming that pressure Pold1 was applied to the first zone of the first substrate, pressure Pold2 was applied to the second zone of the first substrate, pressure Pold3 was applied to the first zone of the second substrate, and pressure Pold4 was applied to the second zone of the second substrate, then new pressure Pnew1 for the first zone of the first substrate can be calculated as Pnew1=Pold1*(SD1/S1), the new pressure Pnew2 for the second zone of the first substrate clan be calculated as Pnew2=Pold2*(SD2/S2), the new pressure Pnew3 for the first zone of the second substrate clan be calculated as Pnew3=Pold3*(SD3/S3), and the new pressure Pnew4 for the second zone of the second substrate clan be calculated as Pnew4=Pold4*(SD4/S4).

The process of determining projected times that the substrates will reach the target thickness, and adjusting the polishing rates, can be performed just once during the polishing process, e.g., at a specified time, e.g., 40 to 60% through the expected polishing time, or performed multiple times during the polishing process, e.g., every thirty to sixty seconds. At a subsequent time during the polishing process, the rates can again be adjusted, if appropriate. During the polishing process, changes in the polishing rates can be made only a few times, such as four, three, two or only one time. The adjustment can be made near the beginning, at the middle or toward the end of the polishing process.

Polishing continues after the polishing rates have been adjusted, e.g., after time T0, the optical monitoring system continues to collect spectra for at least the reference zone and determine index values for the reference zone. In some implementations, the optical monitoring system continues to collect spectra and determine index values for each zone of each substrate. Once the index trace of a reference zone reaches the target index, endpoint is called and the polishing operation stops for both substrates.

Figure 11:
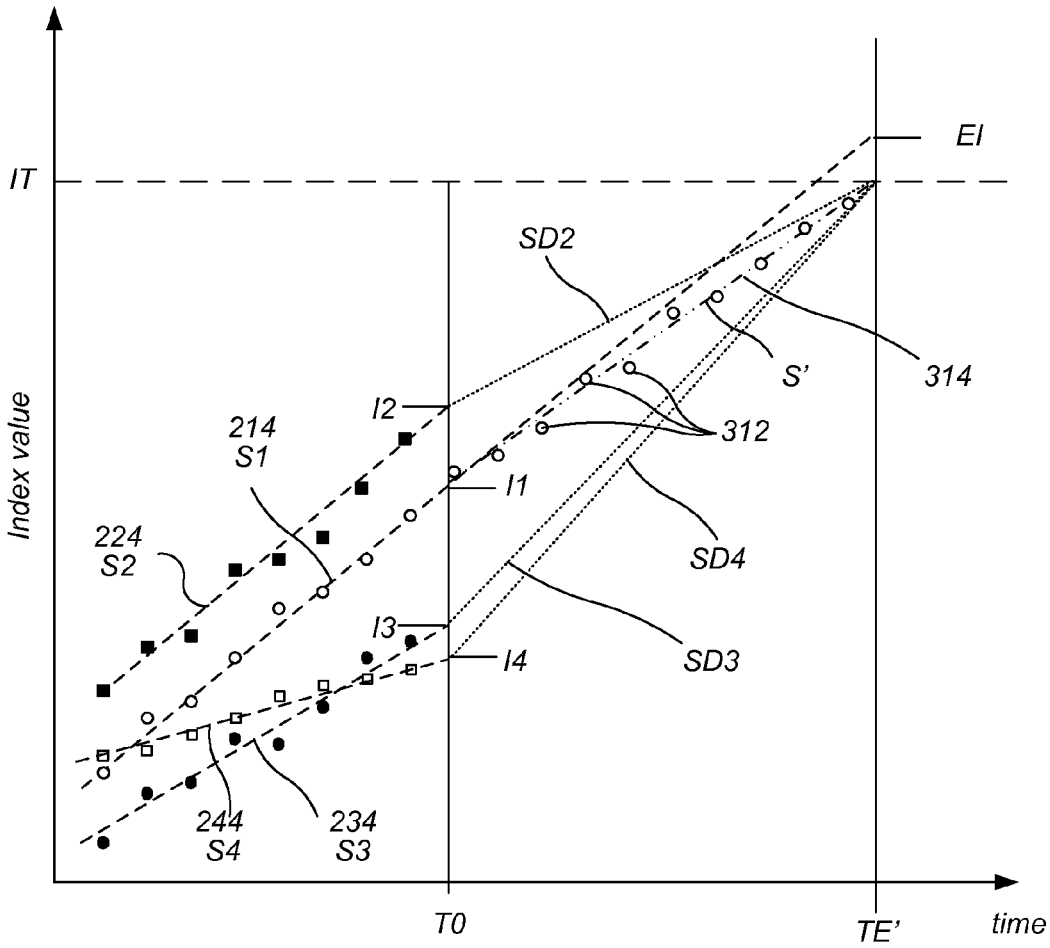
FIG. 11 illustrates a calculation of an endpoint for based on a time that an index trace of a reference zone reaches a target index.

For example, as shown in FIG. 11, after time T0, the optical monitoring system continues to collect spectra for the reference zone and determine index values 312 for the reference zone. If the pressure on the reference zone did not change (e.g., as in the implementation of FIG. 8), then the linear function can be calculated using data points from both before T0 and after T0 to provide an updated linear function 314, and the time at which the linear function 314 reaches the target index IT indicates the polishing endpoint time. On the other hand, if the pressure on the reference zone changed at time T0 (e.g., as in the implementation of FIG. 9), then a new linear function 314 with a slope S' can be calculated from the sequence of index values 312 after time T0, and the time at which the new linear function 314 reaches the target index IT indicates the polishing endpoint time. The reference zone used for determining endpoint can be the same reference zone used as described above to calculate the expected endpoint time, or a different zone (or if all of the zones were adjusted as described with reference to FIG. 8, then a reference zone can be selected for the purpose of endpoint determination). If the new linear function 314 reaches the target index IT slightly later (as shown in FIG. 11) or earlier than the projected time calculated from the original linear function 214, then one or more of the zones may be slightly overpolished or underpolished, respectively. However, since the difference between the expected endpoint time and the actual polishing time should be less a couple seconds, this need not severely impact the polishing uniformity.

Even with the adjustment of the polishing rates as described above with reference to FIG. 8, it is still possible that the actual polishing rate of one or more adjustable zones may not match the desired polishing rate, and thus that adjustable zone may be underpolished or overpolished. In some implementations, a feedback process can be used to correct the polishing rate of the adjustable zones based on the results of polishing of the adjustable zones in previous substrates. The mismatch between the desired polishing rate and the actual polishing rate can be due to process drift, e.g., changes in process temperature, pad condition, slurry composition, or variations in the substrates. In addition, a relationship between pressure change and removal rate change is not always initially well characterized for a given set of process conditions. Therefore, a user will typically run a design of experiment matrix to see the affect of different pressures in various zones on removal rate, or run a series substrates using in-situ process control, tweaking the gain and/or offset settings substrates by substrate the until the desired profile is achieved. However, a feedback mechanism can automatically determine or fine tune this relationship.

In some implementations, the feedback can be an error value based on measurements of an adjustable zone of one or more prior substrates. The error value can be used in the calculation of the desired pressure for an adjustable zone (i.e., other than a reference zone) of a subsequent substrate. The error value can be calculated based on the desired polishing rate (e.g., as represented by the calculated slope SD) and the actual polishing rate after the adjustment, e.g., after T0 (e.g., as represented by the actual slope S'). The error value can be used as a scaling factor to adjust the modification to the pressure on the adjustable zone. For this implementation, the optical monitoring system continues to collect spectra and determine index values for at least one adjustable zone, e.g., each adjustable zones of each substrate, after the adjustment of polishing pressures, e.g., after T0. However, implementations which use this feedback technique can also be applicable where only a single substrate is being polishing on the polishing pad at one time.

In one implementation, the adjusted pressure Pajd to apply to an adjustable zone on a substrate after time T0 when the correction is made, is calculated according to $$P\text{adj}=(P\text{new}-P\text{old})*\text{err}+P\text{new},$$

where Pold was the pressure applied to the zone before time T0, Pnew is calculated as Pnew=Pold*(SD/S), and err is an error value calculated based on the variation of the actual polishing rate of the zone of one or more prior substrates from the desired polishing rate for the zone of those prior substrates.

FIGS. 12A-12D illustrate four situations in which the desired polishing rate for adjustable zone (as represented by the calculated slope SD from the linear function before T0) does not match the actual polishing rate of the adjustable zone (as represented by the actual slope S' from the second linear function after T0). In each of these situations, a sequence of spectra can be measured for the reference zone, index values 212 (for before time T0) and index values 312 (for after time T0) can be determined for the spectra from the reference zone, a linear function 214/314 can be fit to the index values 212 and 312, and the endpoint time TE' can be determined from the time that that the linear function 214/314 crosses the target index IT. In addition, a sequence of spectra can be measured for at least one adjustable zone, e.g., index values 222 (for before time T0) and index values 322 (for after time T0) can be determined for the spectra, a first linear function 224 can be fit to the index values 222 to determine the original slope S for the adjustable zone for before time T0, a desired slope SD for the adjustable zone can be calculated as discussed above, and a second linear function 324 can be fit to the index values 322 to determine the actual slope S' for the adjustable zone after time T0. In some implementations, each adjustable zone of each substrate is monitored and an original slope, a desired slope and an actual slope is determined for each adjustable zone.

Figure 12A:
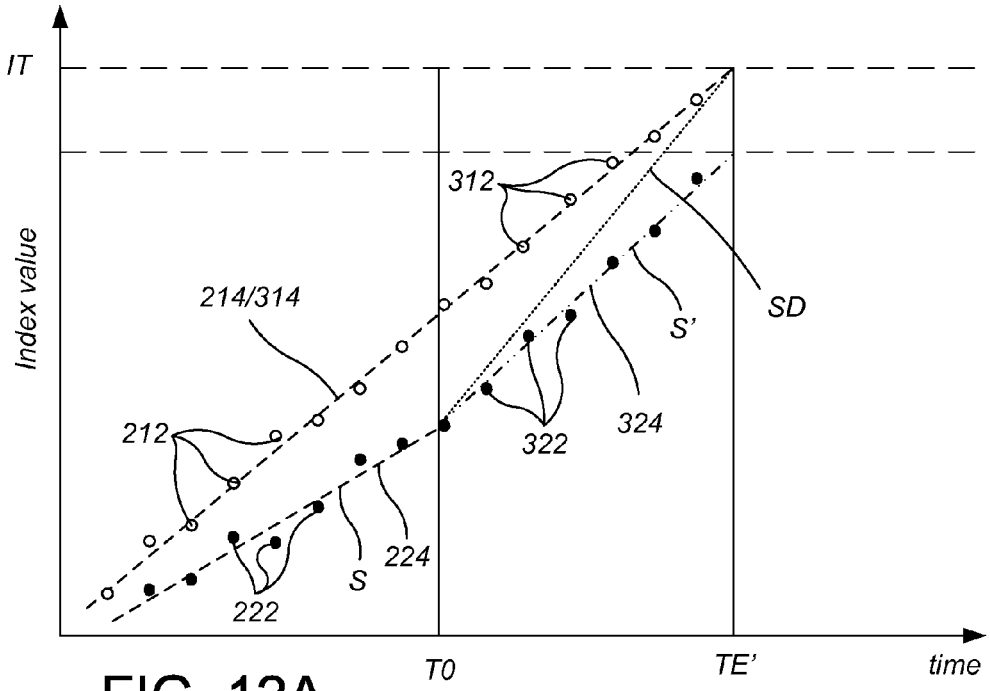
FIGS. 12A-12D illustrate a comparison of a desired slope to an actual slopes in four situations for the purpose of generating an error feedback.

As shown by FIG. 12A, in some situations, the desired slope SD can exceed the original slope S, but the actual slope S' for the adjustable zone can be less than the desired slope SD. Thus, assuming that the reference zone reaches the target index IT at the projected time, the adjustable zone of the substrate is underpolished, since it did not reach the target index by the endpoint time TE'. Because the actual polishing rate S' was less than the desired polishing rate SD for this adjustable zone for this substrate, for a subsequent substrate, the pressure for this adjustable zone should be increased more than the calculation of SD would otherwise indicate. For example, the error err can be calculated as err=[(SD−S')/SD].

Figure 12B:
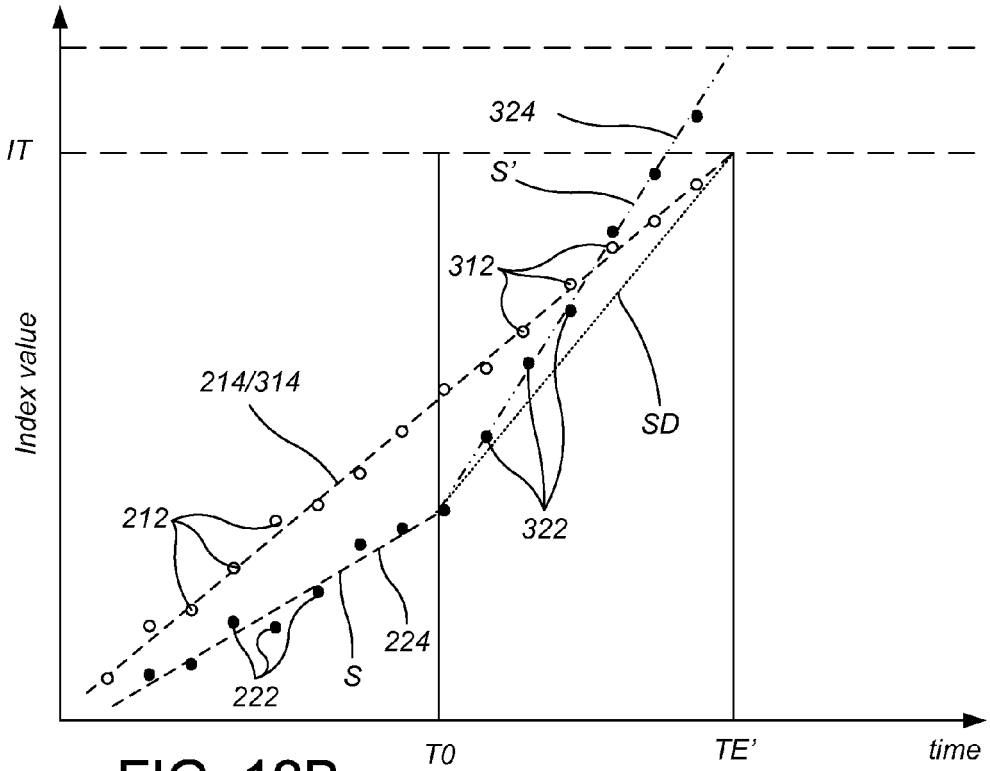

As shown by FIG. 12B, in some situations, the desired slope SD can exceed the original slope S, and the actual slope S' for the adjustable zone can be greater than the desired slope SD. Thus, assuming that the reference zone reaches the target index IT at the projected time, the adjustable zone of the substrate is overpolished, since it exceeded the target index at the endpoint time TE'. Because the actual polishing rate S' was greater than the desired polishing rate SD for this adjustable zone for this substrate, for a subsequent substrate, the pressure for this adjustable zone should be increased less than the calculation of SD would otherwise indicate. For example, the error err can be calculated as err=[(SD−S')/SD].

Figure 12C:
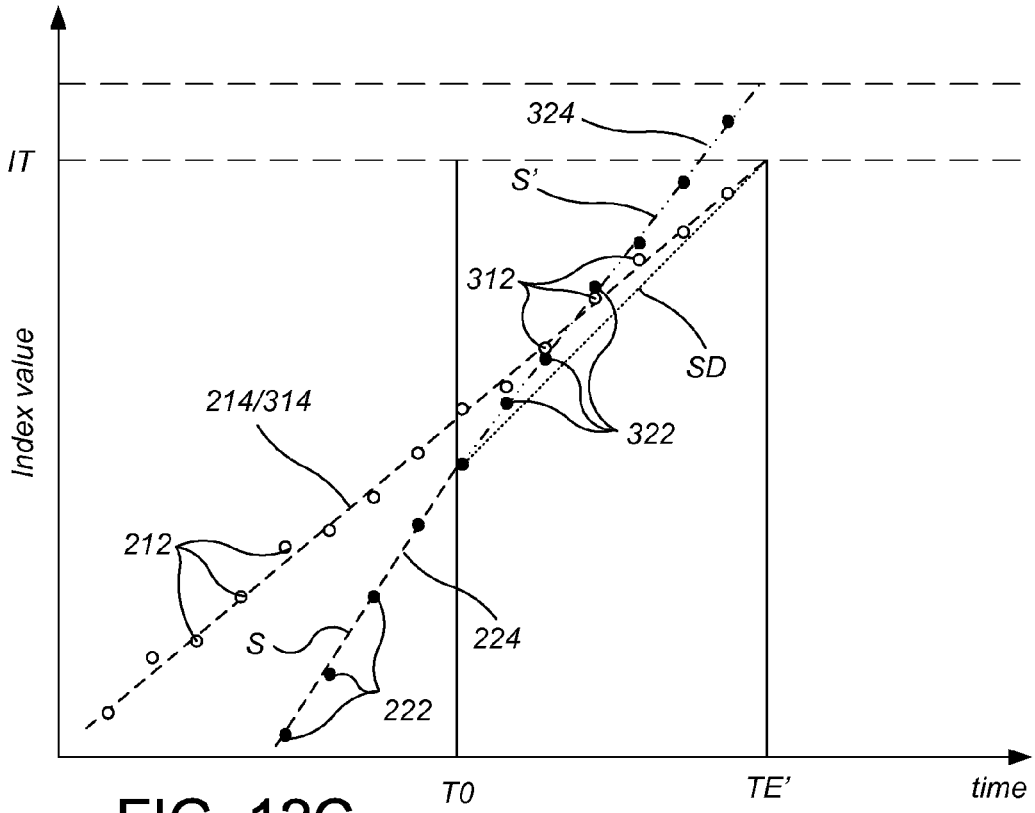

As shown by FIG. 12C, in some situations, the desired slope SD can be less than the original slope S, and the actual slope S' for the adjustable zone can be greater than the desired slope SD. Thus, assuming that the reference zone reaches the target index IT at the projected time, the adjustable zone of the substrate is overpolished, since it exceeded the target index at the endpoint time TE'. Because the actual polishing rate S' was greater than the desired polishing rate SD for this adjustable zone for this substrate, for a subsequent substrate, the pressure for this adjustable zone should be decreased more than the calculation of SD would otherwise indicate. For example, the error err can be calculated as err=[(S'−SD)/SD].

Figure 12D:
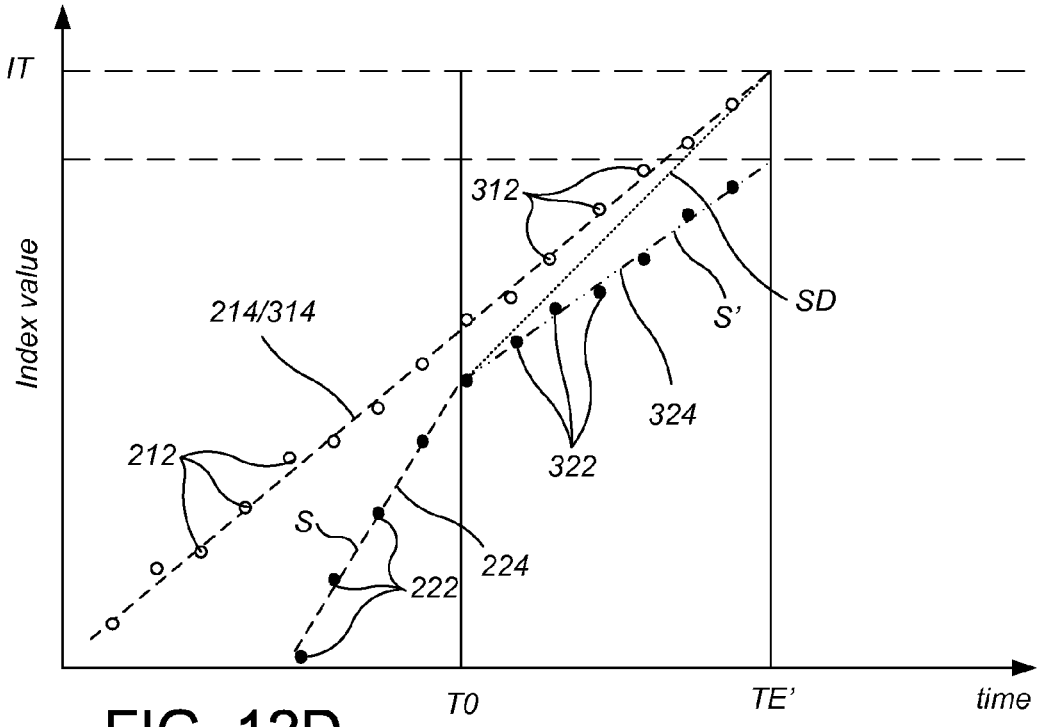

As shown by FIG. 12D, in some situations, the desired slope SD can be less than the original slope S, and the actual slope S' for the adjustable zone can be less than the desired slope SD. Thus, assuming that the reference zone reaches the target index IT at the projected time, the adjustable zone of the substrate is overpolished, since it did not reach the target index at the endpoint time TE'. Because the actual polishing rate S' was less than the desired polishing rate SD for this adjustable zone for this substrate, for a subsequent substrate, the pressure for this adjustable zone should be decreased less than the calculation of SD would otherwise indicate. For example, the error err can be calculated as err=[(S'−SD)/SD].

The implementations discussed above for FIGS. 12A-12D reverse the sign of the error for the situations shown in FIGS. 12C and 12D as compared to FIGS. 12A and 12B. That is, the error signal is reversed when the desired slope SD is greater than the original slope S (i.e., reversed as compared to when the desired slope SD is less than the original slope S).

However, in some implementations, the error can always be calculated in the same manner, err=[(SD−S')/SD]. In these implementations, if the desired slope is greater than the actual slope, then the error is positive, and if the desired slope is less than the actual slope, then the error is negative, regardless of the original slope S.

In some implementations, in each of the cases of FIGS. 12A-12D, the error err calculated for a prior substrate can then be used in the calculation of Padj=(Pnew−Pold)*err+Pnew [Equation 1] for the subsequent substrate.

It can also be noted that rather than apply an error in the calculation of the adjusted pressure, an adjusted target index for the adjustable zone can be calculated. The desired slope would then be calculated based on the adjusted target index. For example, referring to FIG. 13, the adjusted target index ITadj can be calculated as ITadj=SI+(IT−SI)*(1+err), [Equation 2] where IT is the target index, and SI is the starting index at time T0 (as calculated from the linear function 224 or the linear function 324). The error err can be calculated as err=[(IT−AI)/(IT−SI)], where AI is the actual index reached by the adjustable zone at the endpoint time TE' (as calculated from the linear function 324).

In some implementations, applicable to the embodiments of both FIGS. 12A-D and FIG. 13, the error is the accumulated over several prior substrates. In a simple implementation, the total error err used in the calculation for either equation 1 or equation 2 is calculated err=k1*err1+k2*err2, where k1 and k2 are constants, err1 is the error calculated from the immediately previous substrate, and err2 are the error calculated for one or more substrates before the previous substrate.

Figure 13:
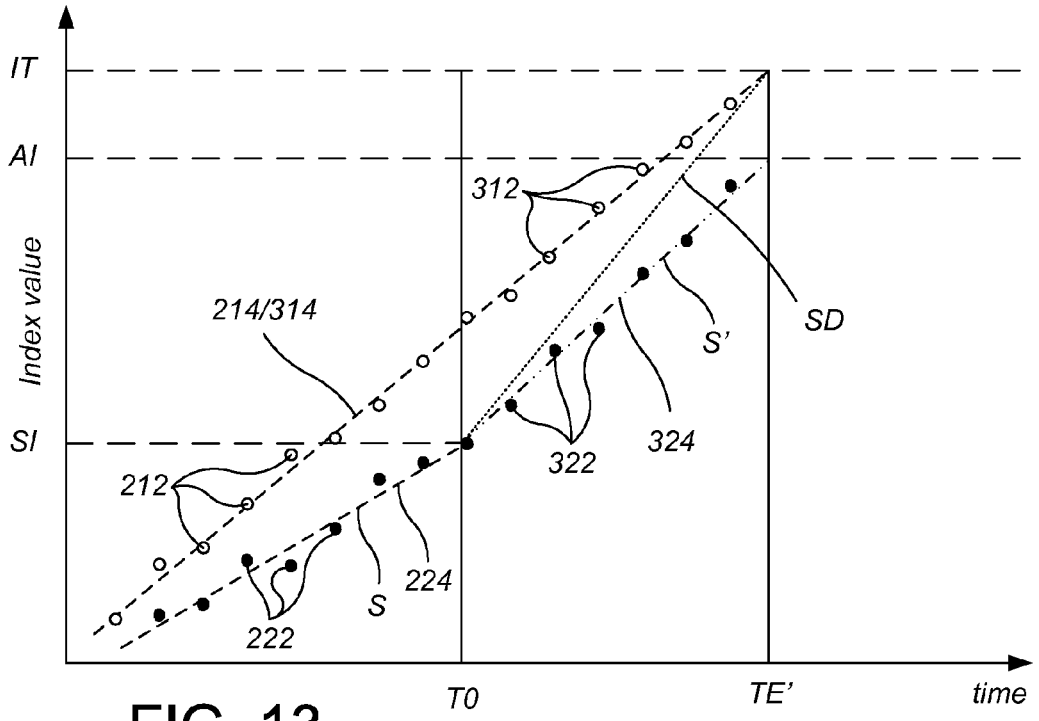
FIG. 13 illustrates a comparison of a target index to an actual index reached by an adjustable zone.

In some implementation, the applied error err used in the calculation for either equation 1 or equation 2 for the present substrate is calculated as a combination of the scaled error of the previous substrate and a weighted average of the applied error from substrates before the previous substrate. This can be expressed as by the following equations:

$$\text{applied err}_{X+1}=\text{scaled error}_X+\text{total error}_{X-1}$$

$$\text{scaled error}_X=k1*\text{err}_X \text{ and}$$

$$\text{total error}_{X-1}=k2*(a1*\text{applied err}_{X-2}+a2*\text{applied err}_{X-3}+\ldots+aN*\text{applied err}_{(X-(N+1))})$$

where k1 and k2 are constants, and a1, a2, . . . aN are constants for a weighted average, i.e., a1+a2+ . . . +aN=1. The constant k1 can be about 0.7, and the constant k2 can be 1. $\text{Err}_X$ is the error calculated for the previous substrate according to one of the above approaches, e.g., $\text{err}_X$=[(SD−S')/SD]

or $err_X$=[(S'−SD)/SD] for the implementations of FIGS. 12A-12D, or $err_X$=[(IT−AI)/(IT−SI)] for the implementation of FIG. 13. The term applied $err_X$ is the applied error for the previous substrate, e.g., assuming the present substrate is substrate X+1, then applied $err_{X-2}$ is the applied error for the third previous substrate, applied $err_{X-2}$ is the applied error for the fourth previous substrate, etc. For either Equation 1 or Equation 2, err=applied $err_{X+1}$.

In some implementations, e.g., for copper polishing, after detection of the endpoint for a substrate, the substrate is immediately subjected to an overpolishing process, e.g., to remove copper residue. The overpolishing process can be at a uniform pressure for all zones of the substrate, e.g., 1 to 1.5 psi. The overpolishing process can have a preset duration, e.g., 10 to 15 seconds.

In some implementations, polishing of the substrates does not halt simultaneously. In such implementations, for the purpose of the endpoint determination, there can be a reference zone for each substrate. Once the index trace of a reference zone of a particular substrate reaches the target index (e.g., as calculated by the time the linear function fit the sequence of index values after time T0 reaches the target index), endpoint is called for the particular substrate and application of pressure to all zones of the particular is halted simultaneously. However, polishing of one or more other substrates can continue. Only after endpoint has been called for the all of the remaining substrates (or after overpolishing has been completed for all substrates), based on the reference zones of the remaining substrates, does rinsing of the polishing pad commence. In addition, all of the carrier heads can lift the substrates off the polishing pad simultaneously.

Where multiple index traces are generated for a particular zone and substrate, e.g., one index trace for each library of interest to the particular zone and substrate, then one of the index traces can be selected for use in the endpoint or pressure control algorithm for the particular zone and substrate. For example, the each index trace generated for the same zone and substrate, the controller 190 can fit a linear function to the index values of that index trace, and determine a goodness of fit of that linear function to the sequence of index values. The index trace generated having the line with the best goodness of fit its own index values can be selected as the index trace for the particular zone and substrate. For example, when determining how to adjust the polishing rates of the adjustable zones, e.g., at time T0, the linear function with the best goodness of fit can be used in the calculation. As another example, endpoint can be called when the calculated index (as calculated from the linear function fit to the sequence of index values) for the line with the best goodness of fit matches or exceeds the target index. Also, rather than calculating an index value from the linear function, the index values themselves could be compared to the target index to determine the endpoint.

Determining whether an index trace associated with a spectra library has the best goodness of fit to the linear function associated with the library can include determining whether the index trace of the associated spectra library has the least amount of difference from the associated robust line, relatively, as compared to the differences from the associated robust line and index trace associated with another library, e.g., the lowest standard deviation, the greatest correlation, or other measure of variance. In one implementation, the goodness of fit is determined by calculating a sum of squared differences between the index data points and the linear function; the library with the lowest sum of squared differences has the best fit.

Figure 14:
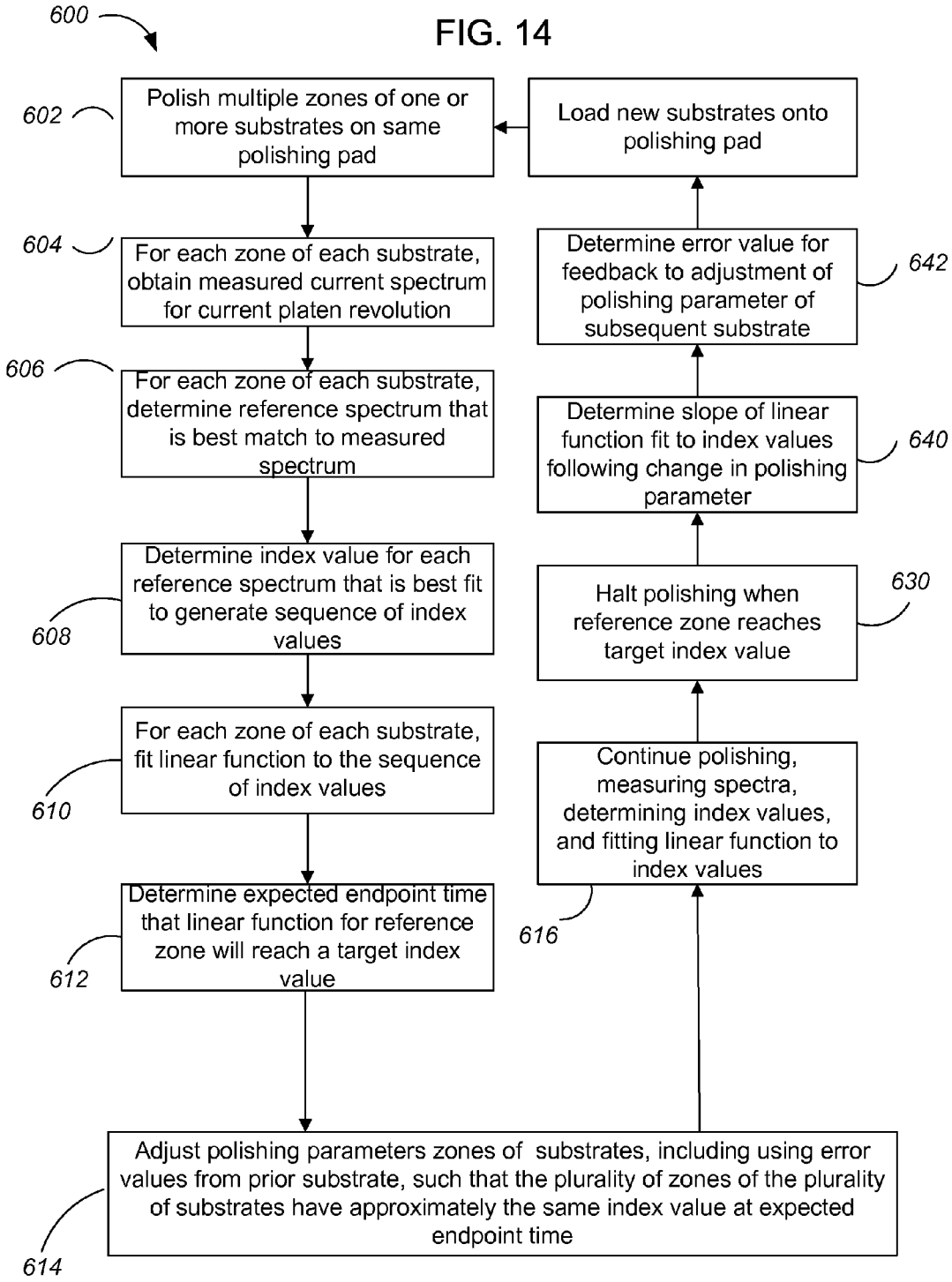
FIG. 14 is a flow diagram of an example process for adjusting the polishing rate of a plurality of zones in a plurality of substrates such that the plurality of zones have approximately the same thickness at the target time.

Referring to FIG. 14, a summary flow chart 600 is illustrated. A plurality of zones of one or more plurality of substrates are polished in a polishing apparatus simultaneously with the same polishing pad (step 602), as described above. During this polishing operation, each zone of each substrate has its polishing rate controllable independently of the other substrates by an independently variable polishing parameter, e.g., the pressure applied by the chamber in carrier head above the particular zone. During the polishing operation, the substrates are monitored (step 604) as described above, e.g., with a measured spectrum obtained from each zone of each substrate. The reference spectrum that is the best match is determined (step 606). The index value for each reference spectrum that is the best fit is determined to generate sequence of index values (step 610). For each zone of each substrate, a first linear function is fit to the sequence of index values (step 610). In one implementation, an expected endpoint time that the first linear function for a reference zone will reach a target index value is determined, e.g., by linear interpolation of the linear function (step 612). In other implementations, the expected endpoint time is predetermined or calculated as a combination of expected endpoint times of multiple zones. If needed, the polishing parameters for the other zones of the other substrates are adjusted to adjust the polishing rate of that substrate such that the plurality of zones of the plurality of substrates reach the target thickness at approximately the same time or such that the plurality of zones of the plurality of substrates have approximately the same thickness (or a target thickness) at the target time (step 614). The step of adjusting the polishing parameter can include using an error value generated from a previous substrate. Polishing continues after the parameters are adjusted, and for each zone of each substrate, measuring a spectrum, determining the best matching reference spectrum from a library, determining the index value for the best matching spectrum to generate a new sequence of index values for the time period after the polishing parameter has been adjusted, and fitting a second linear function to new sequence of index values (step 616). Polishing can be halted once the index value for a reference zone (e.g., a calculated index value generated from the first or second linear function) reaches target index (step 630). For each adjustable zone, the slope of the second linear function fit to the new sequence of index values of that zone (i.e., after the parameters are adjusted) is determined (step 640). For each adjustable zone, an error value is calculated based on the difference between the actual polishing rate (as given by the slope of the second linear function) and the desired polishing rate (as given by the desired slope) for that zone (step 642). At least one new substrate is loaded onto the polishing pad, and the process repeats, with the adjustment to the polishing parameters in step 614 using the error value calculated in step 642.

The techniques described above can also be applicable for monitoring of metal layers using an eddy current system. In this case, rather than performing matching of spectra, the layer thickness (or a value representative thereof) is measured directly by the eddy current monitoring system, and the layer thickness is used in place of the index value for the calculations.

The method used to adjust endpoints can be different based upon the type of polishing performed. For copper bulk polishing, a single eddy current monitoring system can be used. For copper-clearing CMP with multiple wafers on a single platen, a single eddy current monitoring system can first be used so that all of the substrates reach a first breakthrough at the same time. The eddy current monitoring system can then be switched to a laser monitoring system to clear and overpolish the wafers. For barrier and dielectric CMP with multiple wafers on a single platen, an optical monitoring system can be used.

Embodiments of the invention and all of the functional operations described in this specification can be implemented in digital electronic circuitry, or in computer software, firmware, or hardware, including the structural means disclosed in this specification and structural equivalents thereof, or in combinations of them. Embodiments of the invention can be implemented as one or more computer program products, i.e., one or more computer programs tangibly embodied in a machine-readable storage media, for execution by, or to control the operation of, data processing apparatus, e.g., a programmable processor, a computer, or multiple processors or computers. A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code). A computer program can be deployed to be executed on one computer or on multiple computers at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims.

What is claimed is:

1. A computer-implemented method, comprising:

polishing a substrate having a plurality of zones, a polishing rate of each zone being independently controllable by an independently variable polishing parameter;

storing a target value;

measuring a sequence of values from each zone during polishing with an in-situ monitoring system;

for each zone, fitting a first linear function to the sequence of values;

for a reference zone from the plurality of zones, determining a projected time at which the reference zone will reach the target value based on the first linear function for the reference zone; and for at least one adjustable zone, calculating an adjustment for the polishing parameter for the adjustable zone to adjust the polishing rate of the adjustable zone such that the adjustable zone has closer to the target value at the projected time than without such adjustment, the calculation including calculating the adjustment based on a feedback error calculated for a previous substrate;

after adjustment of the polishing parameter, for each zone, during polishing measuring with the in-situ monitoring system a second sequence of values obtained after the adjustment of the polishing parameter;

for the at least one adjustable zone of each substrate, fitting a second linear function to the second sequence of values; and calculating the feedback error for a subsequent substrate for the at least one adjustable zone based on the second linear function and a desired slope.

2. The computer-implemented method of claim 1, wherein the polishing parameter is a pressure in a carrier head of a polishing apparatus.

3. The computer-implemented method of claim 1, further comprising, for each adjustable zone, determining a time at which the adjustable zone will reach the target value.

4. The computer-implemented method of claim 3, further comprising adjusting the polishing parameter for the at least one adjustable zone such that the least one adjustable zone has closer to the target value at the projected time than without such adjustment.

5. The computer-implemented method of claim 4, wherein adjusting the polishing parameter includes calculating a desired slope for the adjustable zone.

6. The computer-implemented method of claim 5, further comprising calculating a projected value for the adjustable zone at which the first linear function for the adjustable zone reaches the projected time.

7. The computer-implemented method of claim 6, wherein calculating the desired slope SD for a zone comprises calculating SD=(IT−I)/(TE−T0), wherein T0 is the time at which the polishing parameter is to be changed, TE is the projected time, IT is the target value, and I is the value of the zone at time T0.

8. The computer-implemented method of claim 7, wherein determining the first linear function includes determining a slope S for the first linear function for a time before time T0.

9. The computer-implemented method of claim 8, wherein adjusting the polishing parameter includes calculating an adjusted pressure Padj=(Pnew−Pold)*err+Pnew, where err is the feedback error, Pnew=Pold*SD/S, and Pold is the pressure applied to the adjustable zone before time T0.

10. The computer-implemented method of claim 9, further comprising determining an actual slope S' from the second linear function.

11. The computer-implemented method of claim 9, wherein the feedback error err is calculated as err=[(SD−S')/SD].

12. The computer-implemented method of claim 10, further comprising determining whether the desired slope SD of the adjustable zone is greater than the slope S of the adjustable zone before the adjustment to the polishing parameter.

13. The method of claim 12, wherein the feedback error err is calculated as err=[(SD−S')/SD] if SD>S and the feedback error err is calculated as err=[(S'−SD)/SD] if SD<S.

14. The method of claim 9, wherein the feedback error err is calculated from an accumulation of feedback errors of the adjustable zone from a plurality of prior substrates.

15. The computer-implemented method of claim 6, wherein calculating the desired slope SD for a zone comprises calculating SD=(ITadj−I)/(TE−T0), wherein T0 is the time at which the polishing parameter is to be changed, TE is the projected time, ITadj is an adjusted target value, and I is the value of the zone at time T0.

16. The computer-implemented method of claim 15, wherein adjusting the polishing parameter includes calculating a new pressure Pnew=Pold*SD/S, where Pold is the pressure applied to the zone before time T0, and slope S is the first linear function for a time before time T0 for the zone.

17. The method of claim 15, further comprising calculating a starting value SI at the time T0 when the polishing parameter is changed.

18. The method of claim 17, wherein the adjusted target value ITadj is calculated as ITadj=SI+(IT−SI)*(1+err), IT is the target value, and SI is the starting value.

19. The method of claim 18, further comprising determining an actual value AI reached by the adjustable zone at an endpoint time TE'.

20. The method of claim 19, wherein determining the actual value AI includes calculating a value of the second function at the endpoint time TE' for the adjustable zone.

21. The method of claim 20, wherein the error err is calculated as err=[(IT−AI)/(IT−SI)], where AI is the actual value, SI is the starting value and IT is the target value.

* * * * *